US005360142A

United States Patent [19]

Stern et al.

[11] Patent Number: 5,360,142

[45] Date of Patent: Nov. 1, 1994

[54] SUPPLY ASSEMBLY FOR WATER PROPELLING DEVICE

[76] Inventors: Gary M. Stern, 561 SW. 75th Ter., Plantation, Fla. 33317; Michael Banschbach, 6521 NW. 24 St., Sunrise, Fla. 33313, Hector Kaba, 1236 Canarias St., Pto. Nuevo, Puerto Rico 00920.

[21] Appl. No.: 985,648

[22] Filed: Dec. 7, 1992

[51] Int. Cl.[5] ..... A63H 3/18

[52] U.S. Cl. ..... 222/79; 222/175; 446/28

[58] Field of Search ..... 222/78, 79, 175, 416; 446/28, 473

[56] References Cited

U.S. PATENT DOCUMENTS

| | | | |
|---|---|---|---|
| 3,197,070 | 7/1965 | Pearl et al. | 222/79 |
| 3,558,020 | 1/1971 | Russell | 222/416 |
| 4,214,674 | 7/1980 | Jones et al. | 222/79 |
| 4,640,446 | 2/1987 | Walker | 222/416 |
| 4,803,974 | 2/1989 | Powell | 222/79 X |
| 4,903,864 | 2/1990 | Sirhan | 222/78 |
| 5,248,089 | 9/1993 | Bekius | 222/175 X |
| 5,303,847 | 4/1994 | Cottone | 222/78 |

FOREIGN PATENT DOCUMENTS

| | | | |
|---|---|---|---|
| 1408230 | 7/1988 | U.S.S.R. | 222/416 |

*Primary Examiner*—Andres Kashnikow
*Assistant Examiner*—Joseph A. Kaufman
*Attorney, Agent, or Firm*—Malloy & Malloy

[57] ABSTRACT

An assembly including a container designed to hold water and having an open mouth or access opening and a cover structure in the form of a removable lid which is selectively disposable over the access opening and also adapted to hold an elongated flexible conduit such that one open end of the conduit is disposed adjacent a bottom of the interior of the container and in contact with the liquid and the opposite end of the elongated conduit is connected to a water propelling device such as a pump type water gun used by children as a toy for propelling water great distances. The container with the cover structure attached thereto includes mounting facilities so as to support the container and the lid with the conduit in its operative position over the shoulders and about the back of a child or other user of the device such that an extended supply of water can be utilized with the water gun giving a child or other user extended periods of usage.

4 Claims, 1 Drawing Sheet

SUPPLY ASSEMBLY FOR WATER PROPELLING DEVICE

BACKGROUND OF THE INVENTION

1. Field of the Invention

This invention relates to a supply and delivery assembly for use in combination with a pump type water gun or other water propelling device wherein the container and delivery structure associated therewith may be mounted and carried with the body of a user of the water gun.

2. Description of the Prior Art

Toy structures for propelling water more commonly known as "water guns" have been in existence and have found popularity with children of all ages for many years. However typically prior art toy guns of the type used some years ago included a hand held gun type structure capable of being supported and operated by a single hand of the child, user and particularly wherein the water gun held its own supply of water. By necessity, due to weight and size restrictions a relatively small amount of water supply was carried within the interior of the water gun. This resulted in requiring the user to frequently refill the gun and to some extent detracted from its enjoyability.

In addition until fairly recently the prior art "water guns" or "squirt guns" only delivered a stream of water a relatively short distance in the range of approximately 3 to 5 feet. However modern day toy propelling devices which also may be termed a water gun operate on a more efficient pump type operation or basis and are capable of delivering a greater quantity of water a much farther distance, in the range of approximately 20 to 30 feet. The result is a significant increase in the popularity of such pump type water guns and the amount of enjoyability being obtained by the children or even adult users.

However, the utilization of such modern day pump type water guns also requires generally larger quantities of a supply of liquid. Again due to the size and weight restrictions such ideal or preferred quantities of liquid cannot be carried inside of the pump gun as with other type squirt gun or water gun designs.

Accordingly, there is a need in this area for not only supply containers which are structurally adapted to carry sufficient quantities of water but also to combine supply and delivery assemblies and structures which are removably connected to a variety of different types of pump water guns and which are further capable of being mounted on and carried with the user even when such user is a small child. The quantity of water contained within such preferred type of containers may be up to and including approximately a liter of water. Such amount, is not sufficiently heavy to overly burden a relatively small child, but it is still a sufficient amount of water to allow a significantly long operational time for the pump type water gun to increase and maintain the period of enjoyability of use of such pump type water guns. Such a preferred supply and delivery assembly should also be of low maintenance and be simple in design and structure so as to not significantly add to the cost and or operation of the pump type water gun or require significant maintenance or repair.

SUMMARY OF THE INVENTION

The present invention relates to a combined supply and delivery assembly for use in combination with a pump type water gun or squirt gun and more specifically comprises a hollow interior container formed of plastic or other lightweight material which does not significantly add to the overall weight of the container when filled or partially filled with water. The container and more specifically the supply of water therein serves as a water supply to be delivered to the pump type water gun for continuous and repeated usage over a relatively prolonged period. It should be further noted, and as will be explained in greater detail hereinafter, the pump type water gun may take any of a variety of existing or new structural configurations and is preferably of the type which is held and operable by the single hand of a user even when the user is of a relatively young age. The container has an opened end or mouth defined more specifically by an access opening. The access opening of course allows water to be passed into the interior of the container or, in certain circumstances when the water is not used completely through operation of the pump type water gun, water may be removed from the interior of the container in a conventional fashion.

The access opening may have part of an attachment means connected about a surrounding peripherally located skirt. Such attachment means may be in the form of an exteriorly threaded surface. A remainder of the attachment means is mounted on what may be referred to as an adaptor means used in part to cover or close the access opening and also to hold an elongated conduit through which water passes.

More specifically, the aforementioned attachment means may include an internally threaded surface peripherally surrounding an attachment opening formed in a base portion of a cover structure. The cover structure is in the form of a cover, lid or the like and is used to be removably attached in overlying relation to the peripherally disposed skirt and to close off the access opening. The conduit is movably and removably attached to the cover structure in a manner which allows oppositely disposed open longitudinal ends thereof to be respectively positioned on the interior of the container in communication with the liquid contained therein and also have the opposite end thereof disposed exteriorly of the container in spaced relation thereto and in connecting relation to the pump type water gun.

Suffice it to say that the attachment opening formed in the cover or lid structure is congruently dimensioned and configured to be attached through mating engagement of the internal and external threaded portions of the cover and of the peripheral skirt such that the cover may be easily removed or attached as desired. Further the structural adaptation of the cover structure to hold the elongated conduit allows movement of the conduit relative to the cover structure so as to both adequately position both of the opposite open ends thereof in the aforementioned positions. A path of liquid flow is thereby established between the liquid supply within the interior of the container and the pump gun itself. Also the length of the conduit should be sufficient so as to allow free positioning or manipulation of the pump gun in the hand of the user. To this end the longitudinal dimension of the conduit should be such as to at least allow an outward spacing of the pump gun, within the hands of the user, to be an arm's distance away from the container or more specifically from the point at which the conduit passes through the adaptor means or cover structure into the interior of the container in communication with the liquid therein.

Proper operation requires the division of a vent means formed in the adaptor or cover structure so as to properly vent and equalize the pressure on the interior of the container and the exterior thereof as the liquid is removed, through the exertion of negative pressure thereon upon operation of the pump structure associated with the water gun or squirt gun manipulated by the hand of the user.

Other structural features associated with the subject assembly is the provision of a mounting means preferably in the form of shoulder straps or other applicable mounting structure securable about the shoulders and or in surrounding relation to the upper arms of the wearer such that the container, when filled or partially filled may be supported in depending relation over the back and beginning adjacent the shoulder area of the user. Such mounting strap assembly may also be adjustable and therefore be movably secured to the cover structure rather than directly to the container itself.

By virtue of the various components set forth above and described in greater detail hereinafter, a supply of water can be carried on the back of even the youngest child who is at least old enough to operate a pump type water gun. Such assembly and the components thereof may be easily assembled in an operative position or detached from one another for storage, cleaning, repair or replacement. An extended period of usage and enjoyability is therefore the result since the pump gun can be utilized for relatively long periods using the approximate one liter of water supply which can easily be carried within the container and have a weight which is not overly burdensome to the body of a child on which it is supported.

BRIEF DESCRIPTION OF THE DRAWINGS

For a fuller understanding of the nature of the present invention reference should be had to the following detailed description taken in connection with the accompanying drawings in which:

FIG. 1 is a perspective view in partial cut-away, section and phantom of the assembly of the present invention in an assembled operative condition.

Like reference numerals refer to like parts throughout the several views of the drawings.

DETAILED DESCRIPTION OF THE PREFERRED EMBODIMENT

Figures 2, 3:
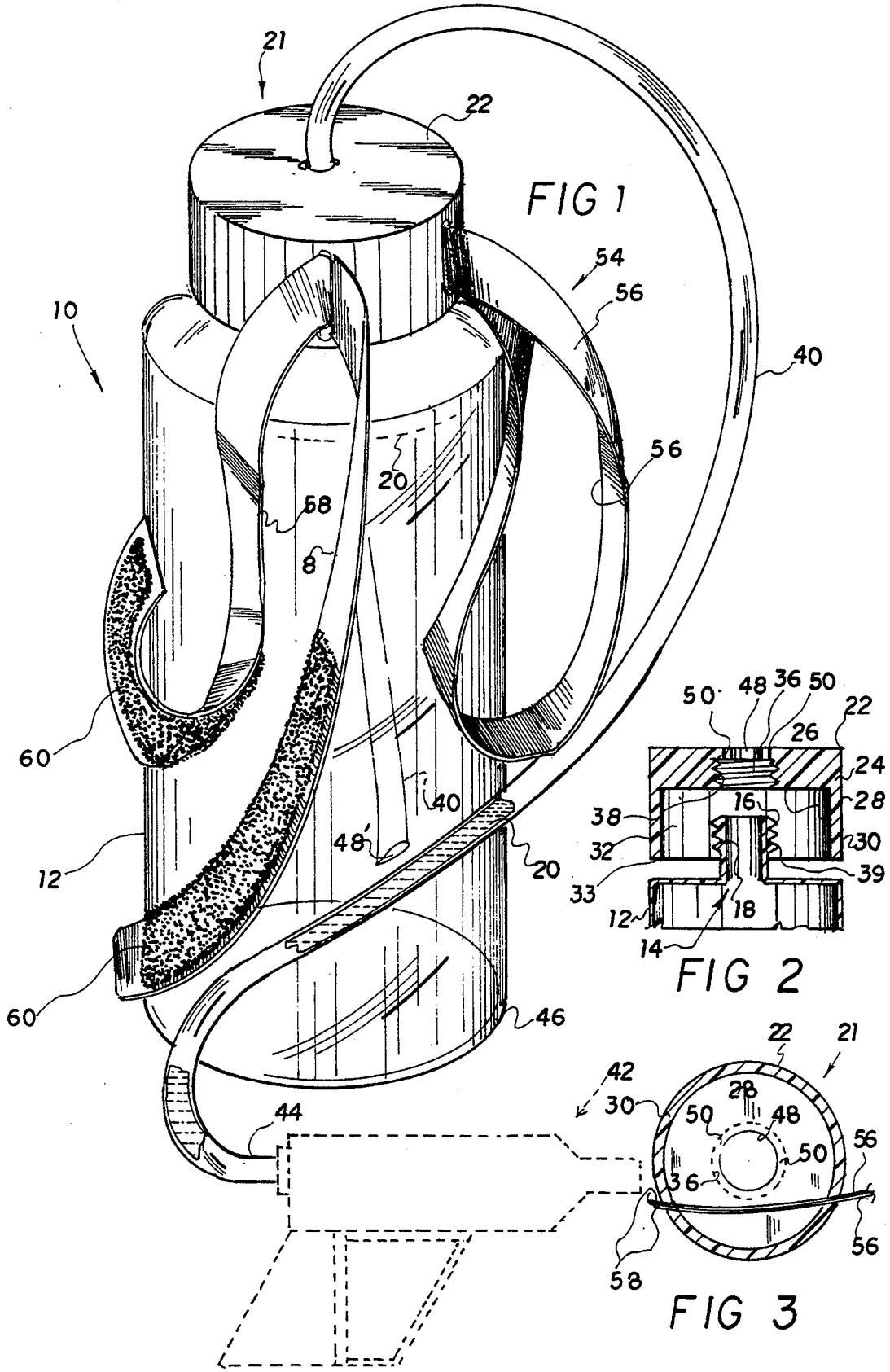
FIG. 2 is a transverse sectional view of an adaptor component of the present invention.
FIG. 3 is a bottom view of the embodiment of FIG. 2 with a mounting strap assembly attached thereto.

As shown in FIG. 1 the combined supply and delivery assembly of the present invention is generally indicated as 10 and the various components thereof are shown in their assembled state. More specifically the subject invention includes a lightweight, plastic or like material container 12 having a hollow interior and being of any one of a variety of sizes. In a preferred embodiment the size may preferably be approximately one liter and resemble a large soda bottle commercially available for the sale of a variety of types of soda type beverages. The container 12 also includes an open mouth generally indicated as 14 and including an access opening 16 formed therein. A depending skirt as at 18 extends downwardly from the access opening and forms a peripheral boundary generally for the access opening as well as the neck of the bottle which again is defined by the peripheral skirt 18. The access opening 16 is sufficiently large so as to allow supply or removal of water or like liquid 20 from the interior of the container in a conventional fashion.

Another important feature of the present invention is the provision of an adaptor means generally indicated as 20. The adaptor means is in the form of a cover structure or lid 22 designed to fit over the neck or skirt portion 18 of the bottle 12 in somewhat covering relation to the access opening 16. The cover structure 22 further includes a base portion 24 having an external surface as at 26 and an internal surface as at 28. A peripheral skirt or angular flange as at 30 is connected to the base as shown in FIG. 2 and extends outwardly therefrom in a common direction. The peripheral skirt or flange 30 therefore forms an open recess as at 32 terminating in an opening as at 33. From a review of FIG. 2 it should be readily apparent that removable attachment of the cover structure 22 to the bottle 12 is accomplished through the provision of an attachment opening 36 having an internally threaded surface as at 38 which is congruent with and serves to removably and threadedly engage the exterior threaded surface as at 39 of the skirt or neck portion 18. By virtue of these two threaded surfaces the cover structure 22 can be easily mounted on or removed from the container 12 in somewhat covering relation to the access opening 16.

Another feature of the present invention is the provision of elongated conduit means 40. The conduit means is formed of a flexible material and is of course hollow along its length to define a path of liquid flow of the liquid 20 from the interior of the container 12 to a pump type water propelling device or squirt gun, water gun, etc. generally indicated and represented in phantom lines as 42. Accordingly, the conduit means 40 has one exteriorly located open longitudinal end 44 attached at any convenient and applicable location to the pump type water gun 42 so as to deliver a supply or flow of water thereto. The opposite end of the conduit means 40 is disposed on the interior of the container 12 generally adjacent to a bottom thereof as at 46 and is indicated as 48'. The lower location of the open end 48 are located within the container 12 generally adjacent to the bottom 46 such that practically all of the water supply 20 can be delivered through the conduit means upon actuation of the pump structure associated with a pump type water gun 42. The details of the pump type water gun 42 may of course vary in accordingly the structural components and operative details thereof are not shown for purposes of clarity.

The adaptor means 21 not only serves to effectively close off the access opening as at 16 but also serves to removably and adjustably position the elongated conduit means 40 such that one end thereof 48 is properly disposed on the interior of the container in fluid communication with the liquid or water 20 contained therein. This also insures that the exterior length of the segment extending outwardly from the cover structure 22, has its free open end 44 connected to the pump water gun 42. To this end the base 24 of the cover structure 22 includes a gripping aperture 48 formed in the base and extending from the outer surface 26 inwardly towards and terminating at the attachment opening 36. The attachment opening 36 of course extends inwardly from the inner surface 28 towards the outer surface 26 but is spaced therefrom as it reaches and terminates at the gripping aperture 48. The gripping aperture 48 has a lesser transverse dimension or inner diameter than does the attachment opening 36. The attachment opening 36, as set forth above, is specifically adapted to be removably attached about the neck or peripheral skirt 18 of the container 12. To the contrary the gripping aperture 48 is specifically dimensioned to frictionally engage the outer surface of the elongated conduit 40 in such a manner as to allow sliding passage of the conduit through the gripping aperture 48. Frictional engagement does exist between the inner surface of the gripping aperture 48 and the outer surface of the conduit 40 to the extent that the conduit is maintained in somewhat of a fixed position once the preferred position is reached. However the frictional engagement is such that the adhering force between the two can be easily overcome upon the exertion of a pulling or pushing force on the conduit so as to properly adjust or position this conduit as desired relative to the interior of the container.

Another feature of the present invention is the provision of vent means in the form of at least one but preferably a plurality of vent channels 50 formed in the base as shown in FIG. 2. The vent channels establish an equilibrium of pressure between the exterior and interior of the container and therefore prevent any vacuum from being created on the interior of the container upon the withdrawal of the liquid therefrom.

The two channels are formed substantially adjacent to and parallel with the gripping aperture 48 and effectively terminate into the attachment opening 36 but more specifically with the access opening 16 such that each of the channels 50 communicate with the interior of the container when the neck or skirt 18 is threadedly engaged into the attachment opening 36. The interior container thereby communicates with atmosphere.

Yet another structure of the present invention is the provision of a mounting means generally indicated as 54. This mounting means includes a strap assembly 56 which may be defined as at least one loop 58 designed to be fit about the shoulders and or upper arms of the user or wearer of the device. The opposite segments 58 may be separated and terminate in free ends which have some type of applicable connector thereto. Accordingly the entire sizing of the strap assembly 56 is adjustable especially wherein various removable connectors such as hook and loop type connectors 60 are formed on appropriately corresponding surfaces of the free end segments 58.

Now that the invention has been described:

What is claimed is:

1. A supply assembly designed for use in combination with a liquid propelling device for delivering liquid thereto, said assembly comprising:

a) a container having a hollow interior and being structurally adapted to hold a quantity of liquid therein, b) conduit means having an elongated configuration and two oppositely disposed open ends and being adapted for conducting liquid from within said container to the liquid propelling device exteriorly of said container, c) one of said openings connected to the liquid propelling device and the other of said open ends disposed within said container in fluid communication with liquid therein, d) adaptor means mounted on said container and connected to said conduit means and structurally adapted for positioning said conduit means at each parcel within said container, e) mounting means secured to said container and adapted for removably mounting said container and adaptor means on the body of the user, f) said conduit means including a sufficiently longitudinal dimension to dispose the propelling device and one of said ends attached thereto a spaced distance from said container and the other of said ends disposed interiorly of the container adjacent the bottom thereof, g) said container including an access opening communicating with said hollow interior and said adaptor means includes a cover structure attached in covering relation to said access opening, h) said cover structure being removably connected to said conduit means and adapted and disposed at opposite ends of said conduit means interiorly and exteriorly respectively of said container, i) said cover structure further including attachment means mounted thereon and structured and disposed to removably secure said cover structure to said container in covering relation to said access opening, j) said attachment means including an attachment opening formed therein and having an internally threaded surface portion defining peripheral boundaries of said attachment opening, k) said attachment means also including an externally threaded skirt portion disposed in surrounding relation to said access opening of said container and congruently dimensioned and configured to be removably attached with said attachment opening and in threaded engagement with said internally threaded surface, l) said mounting means being attached to said cover structure and removably secured to said container at said cover structure, m) said cover structure including a base, and a skirt portion secured continuously about a periphery of said base and extending outwardly therefrom and terminating at an open end, n) said cover structure further including an open recess disposed between an inner surface of said base and said open end and peripherally bounded by said skirt portion, o) said base further including an attachment opening formed on said base and extending inwardly within said base from said inner surface towards and in spaced relation to an outer surface of said base, said attachment opening being adapted to be removably secured about a peripheral boundary surrounding said access opening of said container, p) a gripping aperture formed in said base and extending therethrough from said outer surface of said base inwardly to and in communication with said attachment opening, said gripping aperture dimensioned to allow frictional, movable engagement and passage of said conduit means therethrough, q) said gripping aperture being aligned with and having a similar diameter with said attachment opening, r) vent means formed in said base and extending between said outer surface thereof inwardly in fluid communication with said hollow interior of said container and adapted for establishing a path of air flow between the interior and exterior of said container, and s) said vent means having a plurality of vent chambers extending from said outer surface or said base inwardly to and in communication with said attachment opening.

2. An assembly as in claim 1 wherein said spaced distance of the propelling device from said container is at least equal to an arm's length of the user.

3. An assembly as in claim 1 wherein said gripping aperture is structurally adapted to removably position opposite ones of said two open ends of said conduit on the interior and on the exterior of said container respectively.

4. An assembly as in claim 1 wherein said mounting means comprises a strap assembly movably attached to said cover structure and adjustably passing into and out of said open recess of said cover structure and adapted to be adjustably mounted about the shoulder's of the wearer.

* * * * *